US005685364A

United States Patent [19]

Harris

[11] Patent Number: 5,685,364

[45] Date of Patent: Nov. 11, 1997

[54] SNAP-ON BRACKET FOR A CONDENSER HEADER

[75] Inventor: Matthew K. Harris, Lewisville, Tex.

[73] Assignee: Zexel USA Corporation, Decatur, Ill.

[21] Appl. No.: 616,279

[22] Filed: Mar. 15, 1996

[51] Int. Cl.[6] ..... F28F 9/00

[52] U.S. Cl. ..... 165/67; 62/509

[58] Field of Search ..... 165/67; 62/509

[56] References Cited

U.S. PATENT DOCUMENTS

| | | | |
|---|---|---|---|
| 5,205,349 | 4/1993 | Nagao et al. | 165/67 |
| 5,209,292 | 5/1993 | Arneson et al. | 165/176 |

FOREIGN PATENT DOCUMENTS

| | | | |
|---|---|---|---|
| 3-70994 | 3/1991 | Japan | 165/67 |
| 4-353395 | 12/1992 | Japan | 165/67 |
| 6-123524 | 5/1994 | Japan | 62/509 |

*Primary Examiner*—Allen J. Flanigan
*Attorney, Agent, or Firm*—James E. Bradley

[57] ABSTRACT

A parallel flow heat exchanger is provided having two spaced apart header tubes and a plurality of parallel flow tubes which extend between the header tubes. Prior to passing assembled components of the heat exchanger through a brazing furnace, various external components such as flow fittings and mounting brackets are secured to one of the header tubes by a snap-on brackets which are integrally formed into the external components. Each of the snap-on brackets has a central body portion with a brazing clad, concave contact surface for fitting flush against a side of one of the header tubes. A pair of arms extend from one side of the central body portion, symmetrically spaced apart about a central axis of the snap-on connector for fitting around ribs formed by the edges of the header tubes. Tips are formed on the ends of the arms. The tips have tapered side surfaces which face inward, toward the other arms, for spreading the arms apart as the arms are pressed onto the ribs of the header tube. Continuous shoulders extend along the inward sides of the tips, parallel to the central axis and facing towards the concave contact surface of the central body portion. The continuous shoulders of the tips are spaced apart from the concave contact surface for engaging the ribs of one of the header tubes and holding the central body portion flush against the side of the header tubes for passing through a brazing furnace.

20 Claims, 3 Drawing Sheets

SNAP-ON BRACKET FOR A CONDENSER HEADER

BACKGROUND OF THE INVENTION

1. Technical Field

This invention relates in general to heat exchangers, and in particular to a parallel flow condenser having mounting brackets for securing different components to a condenser assembly for passing through a brazing furnace.

2. Description of the Related Art

Heat exchangers such as parallel flow condensers used in vehicle air conditioning systems have been formed by first assembling brazing clad heat exchanger components together, and then passing the assembled components through a brazing furnace to braze the components together. Some assembly components such as flow fittings and mounting brackets are bolted or tack welded to the header tanks, or tubes, of a condenser assembly. Some of the assembly components which are bolted and tack welded to condensers may also be brazing clad so that they will braze to header tubes of the condenser when the assembly components and header tubes are passed through a brazing furnace. Bolting and tack welding brazing clad components to header tubes is typically manually done, resulting in labor costs for the manufacturing process.

Some prior art heat exchanger components have been mounted to header tubes using mounting brackets having arms with dimples stamped into the ends of arms of the brackets. Typically, the dimples have a round shape and do not securely grip the header tubes. These type of mounting brackets often come loose prior to being passed through the brazing furnace. As a result, they may often be tack welded to hold them in place for passing through the brazing furnace. These mounting brackets are brazing clad for brazing to respective ones of the header tubes.

SUMMARY OF THE INVENTION

A parallel flow heat exchanger is provided having two spaced apart header tubes and a plurality of parallel flow tubes which extend between the header tubes. Prior to passing assembled components of the heat exchanger through a brazing furnace, various external components such as flow fittings and mounting brackets are secured to one of the header tubes by a snap-on brackets which are integrally formed into the components. Each of the snap-on brackets has a central body portion, concave contact surface for fitting flush against a side of one of the header tubes. A pair of arms extend from one side of the central body portion, symmetrically spaced apart about a central axis of the snap-on connector for fitting around ribs formed by the edges of the header tubes. Tips are formed on the ends of the arms. The tips have tapered side surfaces which face inward, toward the other arms, for spreading the arms apart as the arms are pressed onto the ribs of the header tube. Continuous shoulders extend along the inward sides of the tips, parallel to the central axis and facing towards the concave contact surface of the central body portion. The continuous shoulders of the tips are spaced apart from the concave contact surface for engaging the ribs of one of the header tubes and holding the central body portion flush against the side of the header tubes for passing through a brazing furnace.

DETAILED DESCRIPTION OF THE PREFERRED EMBODIMENT

Figure 1:
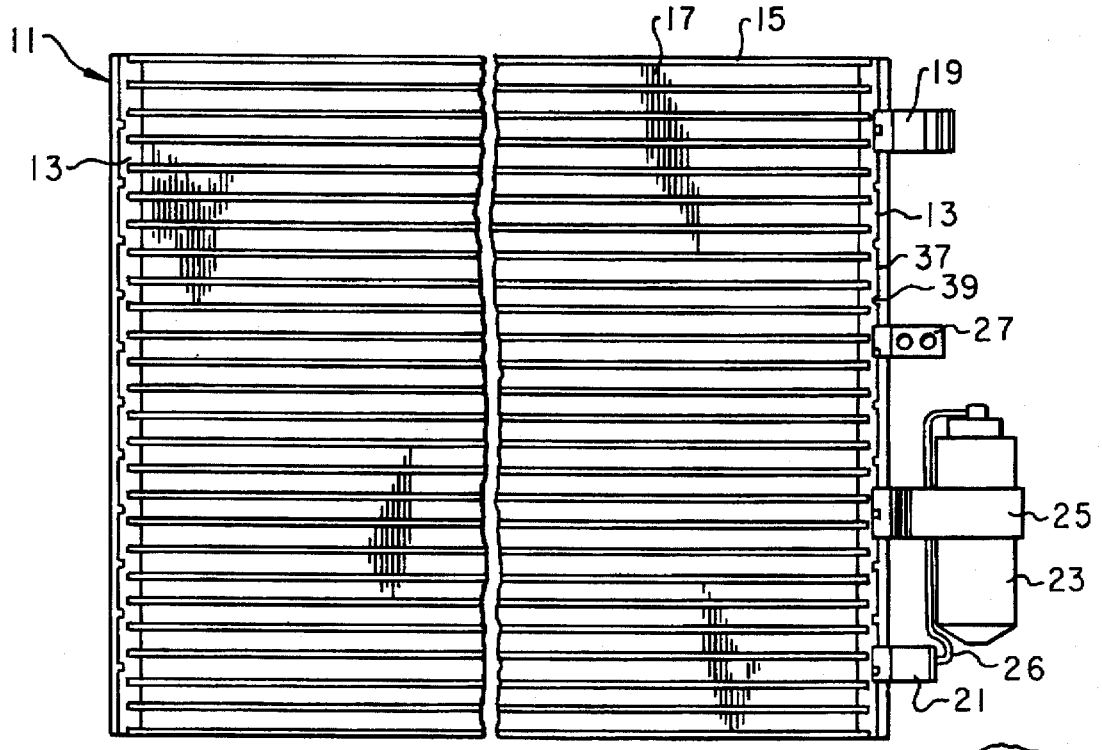
FIG. 1 is a side elevational view of a heat exchanger made according to the present invention.

FIG. 1 is a side elevational view of heat exchanger 11 made according to the present invention. Heat exchanger 11 is of the type normally used in automotive air conditioning systems for a condenser. Heat exchanger 11 includes parallel header tubes 13, the header tubes providing refrigerant tanks for condenser 11. Parallel flow tubes 15 extend between header tubes 13, with fin stock 17 extending between parallel flow tubes 15 and header tubes 13.

A plurality of various external components are mounted to header tubes 13 and included within heat exchanger 11. Such components include inlet flow fitting 19, outlet flow fitting 21, receiver/dryer 23, receiver/dryer mounting bracket 25, by which receiver/dryer 23 is mounted to one of header tubes 13, and condenser mounting bracket 27. Components 19, 21, 25 and 27 are brazing clad for first assembling to one of header tubes 13, then passing through a brazing furnace and brazing to respective ones of header tubes 13. A refrigerant flow tube 26 extends between outlet flow fitting 21 and receiver/dryer 23.

Figure 2:
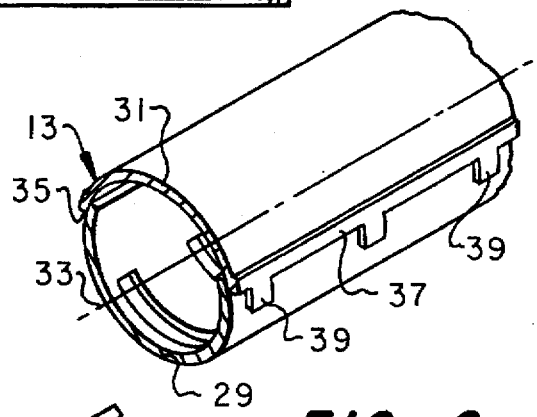
FIG. 2 is a cutaway, partial perspective view of a header tube of a heat exchanger made according to the present invention.

FIG. 2 is a cut-away, partial perspective view of one of header tubes 13. Each of the header tubes 13 is formed by two curved portions 29, 31 which are mated together. Curved portions 29, 31 symmetrically extend around longitudinal axis 33. Curved portions 29, 31 are joined together at seams, which define longitudinally extending ribs along opposite edges of curved portions 29, 31 of header tubes 13. Tabs 39 extend from ribs 37, and are preferably spaced equal distances apart along the edges of header tubes 13. Preferably, header tanks 13 are of an elliptical shape, and formed as set forth in U.S. Pat. No. 5,209,292, issued May 11, 1993 to Zexel USA Corporation, assignee of the present application, and invented by Arneson et al., which is hereby incorporated by reference as if fully set forth herein.

Figure 3:
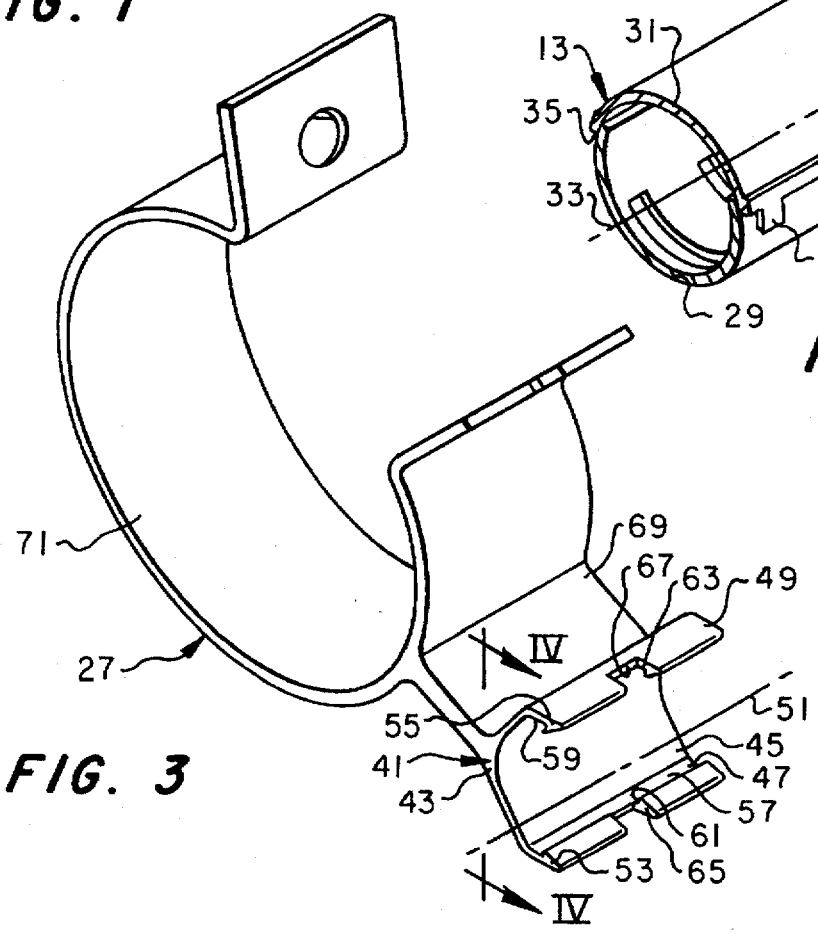
FIG. 3 is a perspective view of a receiver/dryer mounting bracket having an integrally formed snap-on bracket made according to the present invention.

FIG. 3 is a perspective view of condenser mounting bracket 27, which is and extruded fitting that includes an integrally formed snap-on bracket 41. Snap-on bracket 41 includes central body portion 43. A profile of snap-on bracket 41 is defined by concave contact surface 45, which is part of central body portion 43. Concave contact surface 45 has an elliptical shape for mating flush against curved portion 31 of one of header tubes 13. In some embodiments, external contact surface may have a round shape for mating with rounded header tube surfaces and some elliptical header tube surfaces. Pair of arms 47, 49 extend outward from the same side of central body portion 43, in the same direction and symmetrically around central axis 51. Central axis 51 is spaced apart from and parallel to concave contact surface 45.

Arms 47, 49 have end tips 53, 55, respectively. Arms further have sides 57, 59 which extend between concave contact surface 45 of central body portion 43 and tips 53, 55, respectively. Sides 57, 59 face one another. Continuous shoulders 61, 63 are formed between tips 53, 55 and sides 57, 59, respectively. Continuous shoulders 61, 63 preferably have flat surfaces which extend parallel to central axis 51. Notches 65, 67 are formed by slits which extend through tips 53, 55 and into sides 57, 59, respectively. Notches 65, 67 are provided for engaging tabs 39 of header tubes 13 to locate, or position, receiver/dryer mounting bracket 25 relative to one of header tubes 13. Web 69 extends between receiver/dryer clamp 71 and snap-on bracket 41. Snap-on bracket 41, web 69 and receiver/dryer clamp 71 are integrally formed by extrusion.

Figure 4:
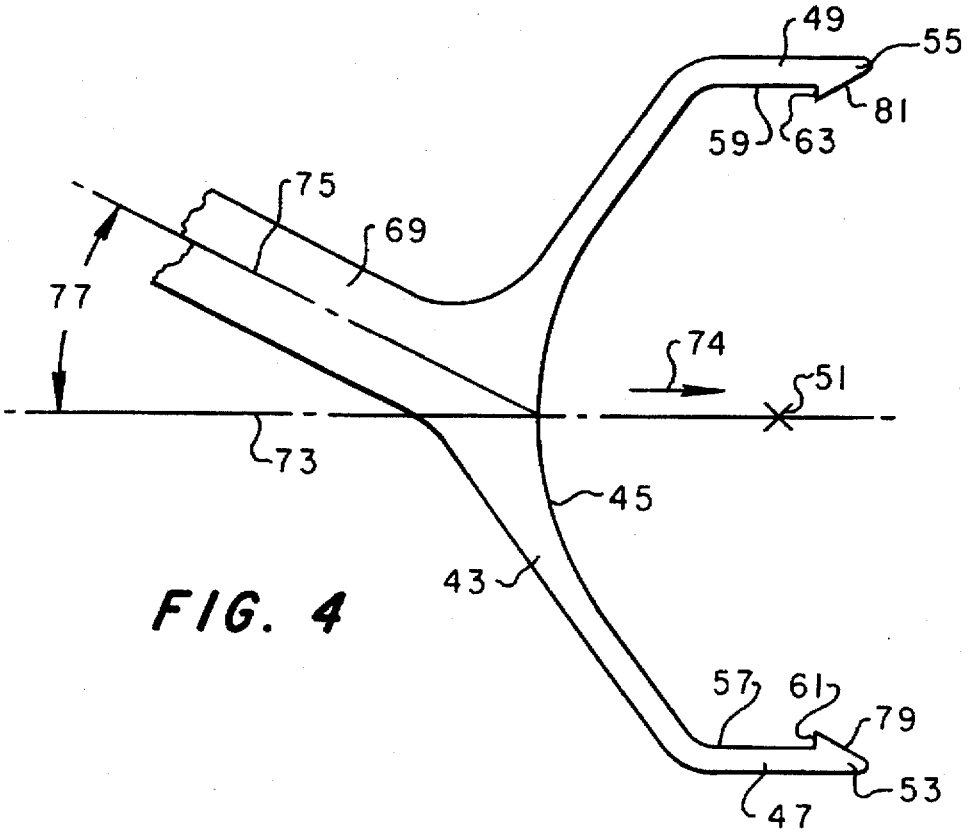
FIG. 4 is a partial section view of the mounting bracket of FIG. 3, taken along section line of IV—IV of FIG. 3.

FIG. 4 is a partial section view depicting a profile of snap-on bracket 41, and is taken along section lines IV—IV of FIG. 3. A portion of web 69 is shown extending from integrally formed snap-on bracket 41. The profile of snap-on bracket 41 includes concave surface 45, sides 57, 59, continuous shoulders 61, 63 and tapered surfaces 19, 81. Centerline axis 73 extends perpendicular to central axis 51, and extends within a plane that bisects snap-on bracket 41 into two symmetrical halves. When snap-on bracket 41 is mounted against one of header tubes 13, it is pushed in direction 74 along the centerline axis 73, with centerline axis 73 extending perpendicular to longitudinal axis 33 and bisecting both of the two halves 29, 31 of one of header tubes 13 (shown in FIG. 2). Web 69 has a centerline axis 75 which extends at an angle 77 from centerline axis 73 of integral snap-on bracket 41. Angle 77 measures approximately 26 degrees.

Two inward facing tapered surfaces 79, 81 are formed on end tips 53, 55, respectively. Tapered surfaces 79, 81 are on the inward sides of end tips 53, 55 for engaging ribs 37 of one of header tubes 13 to spread arms 47, 49 of snap-on bracket 41 outward until shoulders 61, 63 pass ribs 37 as snap-on bracket 41 is being pushed on to one of header tubes 13. Shoulders 61, 63 are spaced apart from concave contact surface 45 so that concave contact surface 45 will be pressed flush against curved portion 31 of one of header tubes 13 when shoulders 61, 63 are engaging against ribs 37 of one of header tubes 13 to hold snap-on bracket 41 in place on heat exchanger 11. Shoulders 61, 63 will hold concave contact surface 45 in place for passing through the brazing furnace to braze snap-on bracket 41 to one of header tubes 13.

Figure 5:
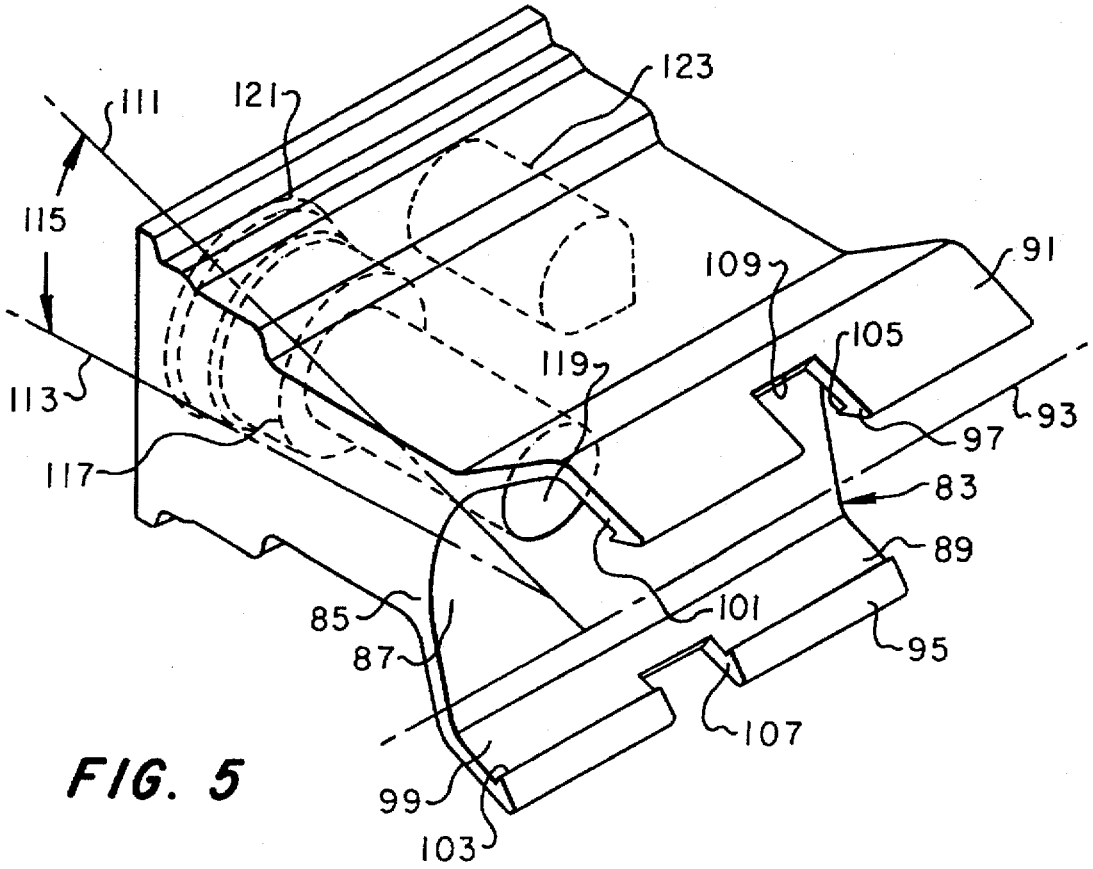
FIG. 5 is a perspective view of an inlet flow fitting having an integrally formed snap-on bracket made according to the present invention.

FIG. 5 is a perspective view of inlet flow fitting 19, which is an extruded fitting having snap-on bracket 83 integrally formed thereon. Snap-on bracket 83 is formed to have a profile similar to the profile of snap-on bracket 41 which is shown in FIG. 4. Snap-on bracket 83 includes central body portion 85 having concave contact surface 87 for fitting flush against the convex exterior shape of one of header tabes 13. Concave contact surface 87 is preferably elliptical or round. Arms 89, 91 extend outward on the same side of central body portion 85, symmetrically extending around central axis 93. Tips 95, 97 are formed on the end of arms 89, 91, and have inward facing tapered surfaces 96, 98, respectively. Arms 89, 91 have oppositely facing sides 99, 101, which face each other. Continuous shoulders 103, 105 extend between tips 95, 97 and sides 99, 101, respectively. Continuous shoulders 103, 105 extend parallel to central axis 93 and concave surface 87. Notches 107, 109 are formed into arms 89, 91, respectively, by slits which extend through tips 95, 97 and into sides 99, 101, respectively.

Snap-on bracket 83 has centerline axis 111 which extends perpendicular to central axis 93, and bi-sects snap-on bracket 83 into two symmetrical halves. Snap-on bracket 83 will be pushed in a direction along central line axis 111 when pressed onto one of header tubes 13. Central body portion 85 extends outward with centerline axis 113 at an angle 115 from centerline axis 111. Angle 115 of inlet flow fitting 19 measures approximately 22 degrees. Flow port 117 extends through central body portion 85, with aperture 119 extending through concave contact surface 87. The opposite side of flow port 117 from aperture 119 defines a socket 121 for receiving a flow connection fitting. Threaded blind hole 123 extends into central body portion 85 from mounting a refrigerant flow fitting to the rearward portion of central body portion 85 of inlet flow fitting 19.

Figure 6:
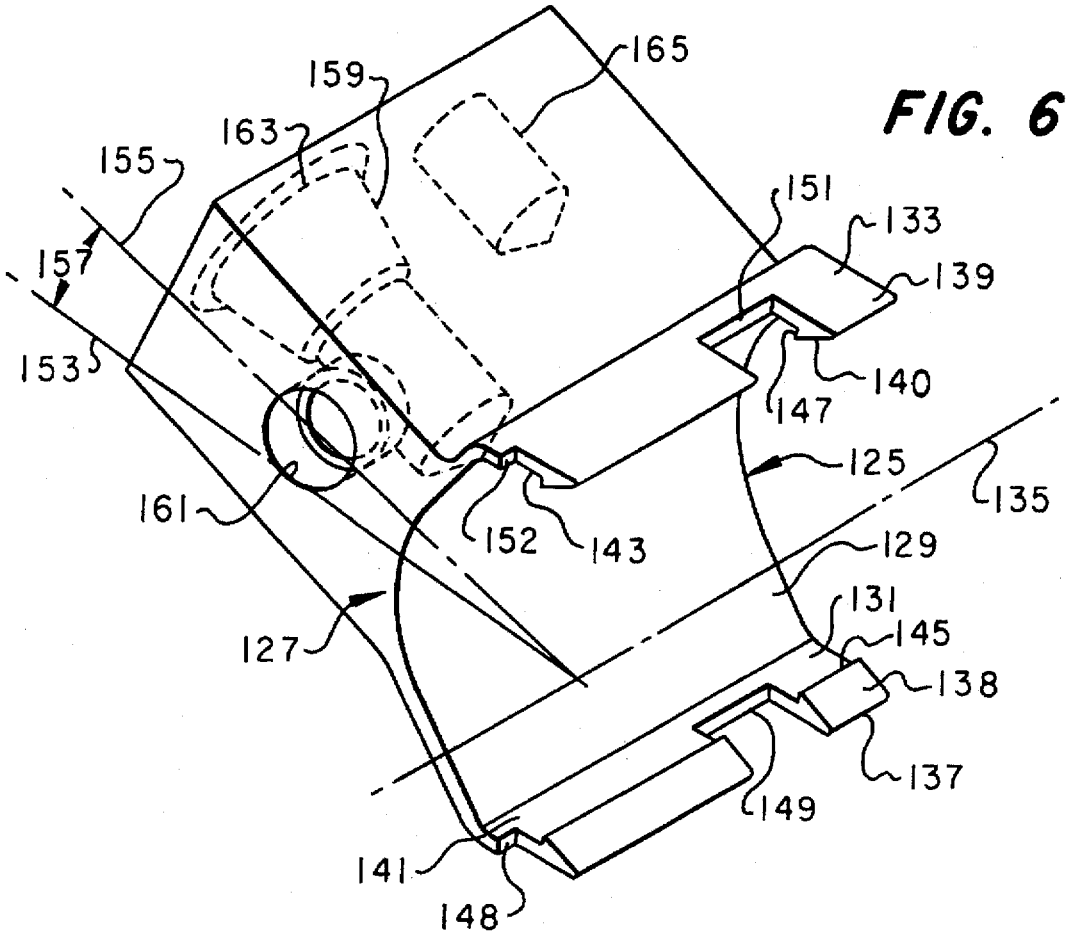
FIG. 6 is a perspective view of an outlet flow fitting having an integrally formed snap-on bracket made according invention.

FIG. 6 is a perspective view of outlet flow fitting 21, which is an extruded fitting that includes integrally formed snap-on bracket portion 125. Snap-on bracket 125 is formed similar to snap-on bracket 41, having the a similar profile to that shown for snap-on bracket 41 in FIG. 4. Snap-on bracket 125 includes central body portion 127 having brazing clad concave contact surface 129. Concave contact surface 129 is preferably a round or elliptical surface which is formed to fit flush against curved portion 31 of one of header tubes 13. Arms 131, 133 extend from the same side of central body portion 127, and symmetrically extend about central axis 135. Tips 137, 139 are formed on the end of arms 131, 133, respectively. Tips 137, 139 have inward facing tapered surfaces 138, 140. Sides 141, 143 of arms 131,133 face each other. Continuous shoulders 145, 147 extend between tips 137, 139 and sides 141, 143, respectively. Sides 141, 143, shoulders 145, 147 and contact surface 129 extend parallel to central axis 135.

Two notches 148, 149 in arms 131 and two notches 151, 152 in arms 133 are formed by slits which cut through tips 137, 139 and into sides 141, 143, respectively. Notches 148, 149, 151 and 152 of snap-on bracket 125 of outlet flow fitting 21 are disposed at different positions along arms 131,133 than the relative positions at which notches 107, 109 of inlet flow fitting 19, and notches 65, 67 of receiver/dryer mounting bracket 27. Notches 148, 149, 151 and 152 are located for each receiving one of tabs 39 of header tubes 13 to locate outlet flow fitting 21 along a respective one of header tubes 13.

Centerline axis 153 bi-sects snap-on bracket portion 125 into two symmetrical halves. Snap-on bracket 125 will be pressed onto one of header tubes 13 by pressing inward along centerline axis 153, with centerline axis 153 being perpendicular to longitudinal axis 33 of one of header tubes 13 (shown in FIG. 2). Central body portion 125 has centerline axis 155 which is perpendicular to central axis 135, and extends at an angle 157 to centerline axis 153. Angle 157 preferably measures 24 degrees. Flow port 159 extends within central body portion 127, having an aperture 161 defining a socket in the side of central body portion 127 for receiving and brazing to a refrigerant flow line. Socket 163 is provided on the opposite side of flow port 159, in the rearward end of central body portion 127. Blind hole 165 is threaded for receiving a fastener to secure a flow connection to central body portion 127 of outlet flow fitting 21.

Figure 7:
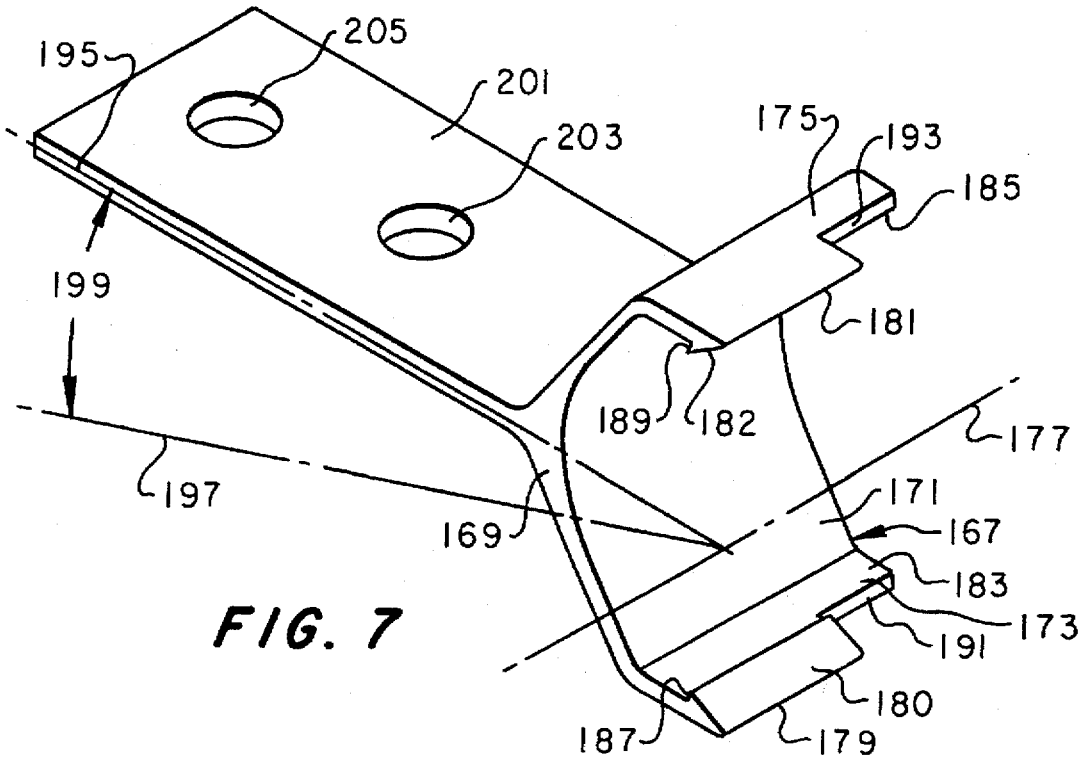
FIG. 7 is a perspective view of a condenser mounting bracket having an integrally formed snap-on bracket made according to the present invention.

FIG. 7 is a perspective view of condenser mounting bracket 27, which is an extruded bracket for mounting heat exchanger 11 (shown in FIG. 1) to a vehicle body. Mounting bracket 27 includes snap-on bracket 127, which is integrally formed thereon. Snap-on bracket 167 includes central body portion 169 having a concave contact surface 171. Concave contact surface 171 is preferably round or elliptically shaped for mounting flush against curved portion 31 of a respective one of header tubes 13. Arms 173, 175 extend on the same side as central body portion 169, symmetrically about central axis 177. Tips 179, 181 are formed on the ends of arms 173, 175. Tips 179, 181 have tapers 180, 182, respectively, which face generally inward and towards each other. Sides 183, 185 of arms 173, 175 face towards one another. Continuous shoulders 187, 189 extend parallel to central axis 177 and concave contact surface 171, between sides 183, 185 and tips 179, 181, respectively.

Notches 191, 193 are formed into the end of arms 173, 175. Notches 191, 193 are located at different positions along arms 173, 175 than the positions along header tubes 13 at which notches 151, 149 are located in arms 131, 133 of outlet flow fitting 21, than the positions at which notches 107, 109 are located into arms 89, 91 of inlet flow fitting 19, and than the positions at which notches 65, 67 are located in arms 47, 49 of receiver/dryer mounting bracket 27. Notches 191, 193 engage tabs 39 of respective one of header tubes 13 (shown in FIG. 2) for locating condenser mounting bracket 27 on a respective one of header tubes 13.

Centerline axis 195 extends perpendicular to central axis 177 and bi-sects snap-on bracket 167 into two symmetrical halves, defined by a sectioning plane which includes both central axis 177 and centerline axis 195. Central body portion 169 of condenser mounting bracket 27 has centerline axis 197, which extends perpendicular to central axis 177 at an angle 199 to centerline axis 195. Angle 199 will typically range from 0 to 30 degrees, but may be angles other those within the range from 0 to 30 degrees. Condenser mounting bracket 27 has a central body portion 169 which has an end which is formed into large flat tab 201 when bracket 27 is extruded. Mounting holes 203, 205 extend through tab 201.

The above condenser components 19, 21, 25 and 27 are formed by extrusion and are brazing clad for passing through a brazing furnace to braze to respective ones of header tubes 13. Components 19, 21, 25 and 27 include integrally formed snap-on brackets 41, 83, 125, and 167, respectively. Extrusion forming snap-on brackets 41, 83, 125, and 167 provides sharp continuous shoulders 61, 63, 103, 105, 145, 147, 187, 189, respectively, which could not formed by other methods, such as stamping.

The profiles of each of the above-disclosed embodiment, snap-on brackets 41, 83, 125 and 167, are symmetrical about two perpendicular axes, the central axis and the centerline axis of each of the respective ones of the snap-on brackets. Snap-on bracket 41 is symmetrical about central axis 51 and centerline axis 75. Snap-on bracket 83 is symmetrical about central axis 93 and centerline axis 111. Snap-on bracket 125 is symmetrical about central axis 135 and centerline axis 155. Snap-on bracket 167 is symmetrical about central axis 177 and centerline axis 195.

The method of assembly of heat exchanger 11 according to the present invention is now described. Header tubes 13 are spaced apart in parallel alignment, with flow tubes 15 extending in parallel between header tubes 13. Fin stock 17 is also placed between flow tubes 15, extending between header tubes 13. Various ones of external components 19, 21, 23, 25 and 27 are mounted to header tubes 13 by snap-on brackets 41, 83, 125, and 167, respectively. Notches 65, 67, 107, 109, 149, 151 and 191, 193 in snap-on brackets 41, 83, 125 and 167, respectively, are aligned with respective ones of tabs 39 of header tubes 13 to located components 19, 21, 23, 25 and 27 with respect to a respective one of header tubes 13. When inlet flow fitting 19 is aligned with one of the respective one of header tubes 13, aperture 119 will be aligned with an aperture formed into the concave contact surface of the respective one of the header tubes 13.

Snap-on brackets 41, 83, 125, and 167 are pressed in direction 74 (shown in FIG. 4), along the direction of the centerline axes 73, 111, 153 and 195, respectively, which are aligned to extend perpendicular to and through longitudinal axis 33 of one of the header tubes 13. Tips 53, 55, 95, 97, 137, 139 and 179, 185 will be pressed outward by the tapered surfaces 79, 81, 138, 140, 180, 182 until continuous shoulders 61, 63, 103, 105, 145, 147, 187, 189 snap into position against ribs 37 of a respective one of header tubes 13. Each of the snap-on brackets 41, 83, 125, and 167 is pressed onto one of the header tubes, until the continuous shoulders, such as shoulders 61, 63, are engaging the ribs 37 of one of header tubes 13 to hold respective ones of contact surfaces 45, 87, 129, and 171 against curved portion 31 of a respective one of header tubes 13. Then, shoulders 61, 63, 103, 105, 145, 147 and 187, 189 hold respective ones of concave contact surfaces 45, 87, 129, and 171 in place, flush against concave surface 31 of one of header tubes 13 for passing through the brazing furnace.

The present invention provides several advantages over the prior art. The mounting brackets of the present invention have profiles which define integrally formed snap-on brackets for securely mounting to header tubes and then passing through a brazing furnace. The snap-on brackets of the present invention have arms into which are formed continuous shoulders. The shoulders are formed by extrusion and extend parallel to a central axis. The continuous shoulders extend for a length along the ribs of header tubes for securely holding a brazing clad central body portion of the snap-on brackets flush against an exterior surface of the header tubes. The arms further have tapered end portions for spreading the arms apart as the snap-on brackets are pushed over the ribs and onto header tubes. The snap-on brackets are pushed directly onto the header tubes, with the arms extending symmetrically around perpendicular centerline axis and central axis, so that the header tubes will not be torqued or twisted while the snap-on brackets are being pushed onto the header tubes. One flow fittings is integrally formed with a brazing clad snap-on bracket made according to the present invention, having a flow port for connecting directly to a flow port in one of the header tubes. This provides labor savings over prior art types of components which have to be bolted or tack welded to header tubes.

While the invention has been shown in only one of its forms, in several alternative embodiments, it should be apparent to those skilled in the art that it is not so limited, but is susceptible to various changes without departing from the scope of the invention.

I claim:

1. In a heat exchanger having two spaced apart header tubes, a plurality of parallel tubes extending between the header tubes for passing refrigerant between the header tubes, and further having external components secured to the header tubes, the header tubes being of two curved portions joined together and having ribs on opposite edges, the improvement comprising:

a central body portion having a concave contact surface for fitting against one of the header tubes;

fastening means for securing one of the external components to the central body portion;

a pair of arms extending from the central body portion, spaced apart for fitting around the ribs of the one of the header tubes, and each of the arms extending symmetrically about a central axis with respect to the other of the arms;

tips formed into each of the ends of the arms to extend substantially parallel to the central axis and the contact surface of the central body portion, and having continuous shoulders with flat inner walls which extend parallel to the central axis; and wherein the shoulders of the tips are spaced apart from the concave contact surface of the central body portion for engaging the ribs of the one of the header tubes for holding the central body portion against the one of the header tubes, with the concave contact surface fitting against the one of the header tubes.

2. The heat exchanger of claim 1, wherein the one of the header tubes has a tab disposed on one of the edges, and one of the tips has a notch extending therein for receiving the tab to locate the central body portion on the one of the header tubes.

3. The heat exchanger of claim 1, wherein the ribs have a plurality of tabs spaced apart along the edges of one of the header tubes, and the arms have notches formed into the tips for receiving the tabs to locate the central body portion relative to the one of the header tubes.

4. The heat exchanger of claim 1, wherein the tips have tapered leading edges disposed equal distances from the central axis on sides of the tips which engage the one of the headers when placing the arms on opposite edges of the one of the headers, the leading edges extending parallel to the central axis and tapering toward the other of the arms in a direction toward the central body portion.

5. The heat exchanger of claim 1, wherein the concave surface of the central body portion is brazing clad surface for brazing to the curved portion of the one of the header tubes.

6. The heat exchanger of claim 1, wherein a flow port extends through the concave surface and the central body portion for aligning with an aperture in the curved portion of the one of the header tubes.

7. The heat exchanger of claim 1, wherein the fastening means comprises a bracket which extends from the central body portion.

8. The heat exchanger of claim 1, wherein the fastening means comprises a generally circular bracket connected to the central body portion by a web integrally formed into central body portion.

9. A heat exchanger comprising in combination:

two spaced apart header tubes, each being of two curved portions joined together at seams which define ribs on opposite edges, the ribs having tabs which are spaced apart along the edges of the header tubes;

the ribs have a plurality of tabs spaced apart along the edges of the header tubes;

a plurality of parallel tubes extending between the header tubes for passing refrigerant between the header tubes;

external components for mounting to the header tubes;

a central body portion having a concave contact surface for fitting flush against one of the curved portions of one of the header tubes;

fastening means for securing one of the external components to the central body portion;

a pair of arms extending from the central body portion, spaced apart for fitting around the ribs of the one of the header tubes, and each of the arms extending symmetrically about a central axis with respect to the other of the arms and being formed by extrusion;

tips formed into the ends of the arms to extend substantially parallel to the central axis and the contact surface of the central body portion;

the tips having tapered leading edges disposed equal distances from the central axis on sides of the tips which engage the one of the headers when placing the arms on opposite edges of the one of the headers, the leading edges extending parallel to the central axis and tapering toward the other of the arms in a direction toward the central body portion;

the arms having side surfaces which face the other of the arms and extend symmetrically about the central axis to the other of the arms, and continuous shoulders with flat inner walls which extend between the side surfaces and the tips of the arms and face generally toward the central body portion;

the arms have notches formed into the tips for receiving the tabs on the ribs to locate the central body portion relative to the one of the header tubes; and wherein the shoulders are spaced apart from the concave contact surface of the central body portion for engaging the ribs of the one of the header tubes for holding the central body portion against the one of the header tubes, with the concave contact surface fitting flush against the curved portion and the central axis extending parallel to a longitudinal axis of the one of the header tubes.

10. The heat exchanger according to claim 9, wherein the continuous shoulders are disposed perpendicular to the side surfaces of the arms.

11. The heat exchanger according to claim 9, wherein the side surfaces of the arms are parallel to one another.

12. The heat exchanger according to claim 9, wherein:

the continuous shoulders are disposed transverse to the side surfaces of the arms; and the side surfaces of the arms are parallel to one another.

13. The heat exchanger according to claim 9, wherein the notches extend into the side surfaces.

14. The heat exchanger according to claim 9, wherein the fastening means comprises a bracket which extends from the central body portion.

15. The heat exchanger according to claim 9, wherein the fastening means comprises a generally circular bracket connected to the central body portion by a web integrally formed into central body portion.

16. A method for fabricating a heat exchanger of the type having two spaced apart header tubes, a plurality of parallel tubes extending between the header tubes for passing refrigerant between the header tubes, and further having external components secured to the header tubes, the header tubes being of two curved portions joined together at seams which define ribs on opposite edges of the header tubes, the method comprising the steps of:

providing a snap-on bracket having a central body portion with a concave surface for fitting flush against one of the header tubes, a pair of spaced apart arms extending from the central body portion symmetrically about a central axis with respect to the other of the arms, and continuous shoulders with flat inner walls formed into the ends of the arms to extend substantially parallel to the central axis and the concave surface of the central body portion;

fitting end tips of the arms against the ribs of the one of the header tubes, with the central axis align parallel to a longitudinal axis of the one of the header tubes;

pressing forward with substantially straight axial movement along a centerline which is equidistance between each of the tips and which intersects both the central axis of the snap-on bracket and the longitudinal axis of the one of the header tubes;

pressing the tips over the ribs and catching the continuous shoulders against the ribs on opposite edges of the one of the header tubes, with the concave surface of the central body portion fitting flush against the one of the header tubes; then, passing the heat exchanger through a brazing furnace, brazing the snap-on bracket to the one of the header tubes; and fastening one of the external components to the central body portion to secure the one of the external components to the one of the headers.

17. The method according to claim 16, further comprising the steps of:

providing the seams of the header tubes with tabs which extend outward from the ribs;

providing slots in the tips of the arms; and aligning the slots around the tabs when pressing the snap-on bracket onto the one of the header tubes, to locate the snap-on bracket along the longitudinal axis of the one of the header tubes.

18. The method according to claim 16, further comprising the steps of:

providing the seams of the header tubes with a plurality of tabs which extend outward from the ribs on opposite sides of the ribs and which are spaced apart along the longitudinal axis of the one of the header tubes;

providing additional brackets having the features of the snap on bracket as set forth in claim 16 above;

providing slots in the tips of the arms of the plurality of the additional brackets, with the slots in the different ones of the additional brackets being disposed at different distances from the ends of the additional brackets along lines which are parallel to the central axis of each of the brackets;

aligning the slots of the additional brackets with respective ones of the tabs when pressing the additional brackets onto the header tubes, to locate the different ones of the additional brackets in respective positions along the longitudinal axis of the one of the header tubes;

in the step of passing the heat exchanger through a brazing furnace, brazing the additional brackets to the header tubes; and mounting additional external components to respective ones of the additional brackets.

19. The method according to claim 16, wherein the step of providing the snap-on bracket comprises:

providing a metal blank and a forming die; and extruding metal blank through the forming die to provide concave surface of the central body, the arms and the continuous shoulders.

20. The method according to claim 16, wherein the snap on bracket is brazing clad and the brazing clad is flowed within the brazing furnace to braze the snap-on bracket to the one of the headers tubes.

* * * * *